US010898993B2

(12) United States Patent
Tanaka

(10) Patent No.: US 10,898,993 B2
(45) Date of Patent: Jan. 26, 2021

(54) DRIVING TOOL

(71) Applicant: MAX CO., LTD., Tokyo (JP)

(72) Inventor: Hiroshi Tanaka, Tokyo (JP)

(73) Assignee: MAX CO., LTD., Tokyo (JP)

( * ) Notice: Subject to any disclaimer, the term of this patent is extended or adjusted under 35 U.S.C. 154(b) by 231 days.

(21) Appl. No.: 16/138,602

(22) Filed: Sep. 21, 2018

(65) Prior Publication Data

US 2019/0099870 A1 Apr. 4, 2019

(30) Foreign Application Priority Data

Sep. 29, 2017 (JP) ..... 2017-191694

(51) Int. Cl.

| | |
|---|---|
| ***B25C 1/04*** | (2006.01) |
| ***B25C 1/00*** | (2006.01) |
| ***B25C 1/06*** | (2006.01) |
| *B25C 5/15* | (2006.01) |

(52) U.S. Cl.

CPC ..... *B25C 1/043* (2013.01); *B25C 1/008* (2013.01); *B25C 1/047* (2013.01); *B25C 1/06* (2013.01); *B25C 1/042* (2013.01); *B25C 1/046* (2013.01); *B25C 5/15* (2013.01)

(58) Field of Classification Search

CPC ..... B25C 1/043; B25C 1/047; B25C 1/008; B25C 1/042; B25C 5/15; B25C 1/046

USPC ..... 227/2, 8, 107–155

See application file for complete search history.

(56) References Cited

U.S. PATENT DOCUMENTS

| | | | | |
|---|---|---|---|---|
| 3,964,659 | A | 6/1976 | Eiben et al. | |
| 4,509,668 | A | 4/1985 | Klaus et al. | |
| 5,597,106 | A * | 1/1997 | Hamano | B25C 1/008 227/130 |
| 6,929,165 | B1 * | 8/2005 | Chen | B25C 1/008 227/142 |

(Continued)

FOREIGN PATENT DOCUMENTS

| | | |
|---|---|---|
| EP | 0 736 360 A2 | 10/1996 |
| JP | 2016179526 A | 10/2016 |

OTHER PUBLICATIONS

European Search Report issued in Application No. 18196187.1, dated Mar. 1, 2019 (8 pages).

*Primary Examiner* — Hemant Desai
*Assistant Examiner* — Christopher Robin Kim
(74) *Attorney, Agent, or Firm* — Rothwell, Figg, Ernst & Manbeck, P.C.

(57) ABSTRACT

A driving tool drives a fastener by a striking mechanism which is operated by a fluid. The driving tool includes a trigger, a contact arm, a contact lever and a regulator. The trigger and the contact arm receive manipulations and the contact lever switches operating states of the striking mechanism according to operations of the trigger and the contact arm. The regulator switches operating states of the contact lever according to the contact arm. The regulator includes a regulation member and a controller. The regulation member regulates the contact lever at an operation standby position where the contact lever is operated by the contact arm. The controller operates the regulation member and includes first and second cylinders. The first cylinder operates the regulation member. The second cylinder to which a fluid operating the striking mechanism is partially supplied and generates a driving force for driving the first cylinder.

7 Claims, 8 Drawing Sheets

(56) References Cited

U.S. PATENT DOCUMENTS

| | | | | |
|---|---|---|---|---|
| 7,213,733 | B1 * | 5/2007 | Wen | B25C 1/008 227/142 |
| 2005/0023318 | A1 * | 2/2005 | Aguirre | B25C 1/008 227/8 |
| 2005/0205638 | A1 * | 9/2005 | Wang | B25C 1/04 227/8 |
| 2006/0261121 | A1 * | 11/2006 | Uchiyama | B25C 1/008 227/8 |
| 2009/0302087 | A1 * | 12/2009 | Liang | B25C 1/008 227/130 |
| 2010/0252608 | A1 * | 10/2010 | Lai | B25C 1/047 227/8 |
| 2010/0301091 | A1 * | 12/2010 | Liang | B25C 1/008 227/8 |
| 2014/0158740 | A1 * | 6/2014 | Akutsu | B25C 1/046 227/130 |
| 2015/0090758 | A1 * | 4/2015 | Ishizawa | B25C 1/008 227/8 |
| 2017/0274512 | A1 * | 9/2017 | Ishizawa | B25C 1/04 |
| 2018/0117748 | A1 * | 5/2018 | Ishikawa | B25C 1/06 |
| 2019/0022842 | A1 * | 1/2019 | Oouchi | B25C 1/047 |
| 2019/0099870 | A1 * | 4/2019 | Tanaka | B25C 1/06 |
| 2019/0099871 | A1 * | 4/2019 | Fukushima | B25C 1/047 |
| 2019/0099872 | A1 * | 4/2019 | Tanaka | B25C 1/008 |
| 2019/0291253 | A1 * | 9/2019 | Knight | B25C 1/043 |

* cited by examiner

DRIVING TOOL

CROSS-REFERENCE TO RELATED APPLICATION

This application is based on and claims priority under 35 USC119 from Japanese Patent Application No. P2017-191694 filed on Sep. 29, 2017.

TECHNICAL FIELD

The present invention relates to a driving tool driven by a fluid such as compressed air.

BACKGROUND

A driving tool called as a nailing machine is known, in which the driving tool operates a piston with a striking mechanism using a fluid such as compressed air as a driving power source and drives a driver coupled to the piston, in order to strike a fastener such as a nail coupled to a nose. In such a nailing machine, the striking mechanism is operated by manipulating two members, that is, one manipulation of pulling a trigger provided on a handle and another manipulation of pressing a contact arm that protrudes from a proximal end of the nose so as to reciprocate against a driven member, in order to drive a nail.

In following description, a state in which the trigger is pulled according to one manipulation will be referred to as ON state of the trigger, and a state in which one manipulation is canceled and the trigger is not pulled will be referred to as OFF state of the trigger. In another manipulation, a state in which the contact arm is pressed will be referred to as ON state of the contact arm, and a state in which another manipulation is canceled and the contact arm is not pressed will be referred to as OFF state of the contact arm.

In the nailing machine, for example, after the contact arm is ON, the trigger is ON in a state where the contact arm is ON, and whereby the striking mechanism is operated and a nail driving is performed.

After driving the nail, the trigger and the contact arm are OFF, and then, the trigger and the contact arm are ON again as described above, so that the striking mechanism is operated and a next nail driving is performed. As described above, for every nail driving operation, when the trigger and the contact arm are ON after the trigger and the contact arm are OFF, a next nail driving is performed, and this operation is referred to as a single shot mode.

On the other hand, a technique in which the trigger is maintained to be ON and the contact arm is OFF after driving the nail and then the contact arm is ON again to operate the striking mechanism and perform a next nail driving operation has been suggested. As described above, an operation of continuously performing nail driving operations by repeatedly turning ON/OFF of the contact arm in a state where the ON state of the trigger is maintained is referred to as a continuous strike mode.

In the continuous strike mode, the nail driving may be performed continuously whenever the contact arm is pressed against the driven member in a state where the trigger is pulled after each nail driving operation, and thus, the continuous strike mode is suitable for a fast work. On the other hand, in the single shot mode, since a next nail driving is performed by cancelling manipulations of the trigger and the contact arm after the nail is driven and by pulling the trigger after pressing the contact arm against the driven member, a careless operation may be restricted, but the single shot mode is not suitable for the fast work. Thus, there has been suggested a technique allowing continuous nail driving operations to be performed only with an operation of pressing the contact arm against the driven member without releasing the manipulation of the trigger for a predetermined time period after a first nail driving operation performed by pulling the trigger after pressing the contact arm against the driven member (for example, see JP-A-2016-179526).

SUMMARY

In the configuration in which the continuous strike operation of the nail, etc. may be performed only by pressing the contact arm against the driven member without releasing the manipulation of the trigger, a control allowing the continuous strike operation to be performed for a predetermined time period is made by using an electrical timer, and thus, a time measurement may be stabilized. However, the nailing machine driven by the compressed air does not use a source of electricity. Therefore, in order to use the electrical timer, a power source and a circuit are necessary.

On the other hand, there may be suggested a configuration in which a timer is operated and execution of the continuous strike operations may be switched by using the compressed air. However, the compressed air supplied to the nailing machine may include foreign substances such as dust or oil, and thus, according to the configuration of switching the execution of the continuous strike operations by using a striking mechanism operated by the compressed air, the switching of the execution of the continuous strike operations may not be stably performed.

The present invention has been made in view of these circumstances, and an object thereof is to provide a nailing machine capable of stably switching whether to perform a continuous strike operation according to an operation of the contact arm by using a configuration using a fluid.

According to one aspect of the disclosure, a driving tool is configured to drive a fastener supplied to a nose by using a striking mechanism which is operated by a fluid to be supplied. The driving tool includes a trigger, a contact arm, a contact lever and a regulator. The trigger is configured to receive a manipulation which operates the striking mechanism. The contact arm is configured to receive another manipulation which operates the striking mechanism. The contact lever is configured to operate according to operations of the trigger and the contact arm and is configured to switch operating states of the striking mechanism. The regulator is configured to switch operating states of the contact lever according to the contact arm. The regulator includes a regulation member and a controller. The regulation member is configured to regulate a position of the contact lever at an operation standby position where the contact lever is operated by the contact arm. The controller is configured to operate the regulation member. The controller includes a first cylinder and a second cylinder. The first cylinder is configured to operate the regulation member. a fluid operating the striking mechanism is partially supplied to the second cylinder and the second cylinder is configured to generate a driving force for driving the first cylinder.

DETAILED DESCRIPTION

Hereinafter, a nailing machine as an example of a driving tool according to an embodiment of the present invention will be described with reference to accompanying drawings.

An Example of a Nailing Machine According to a First Embodiment

Figure 1:
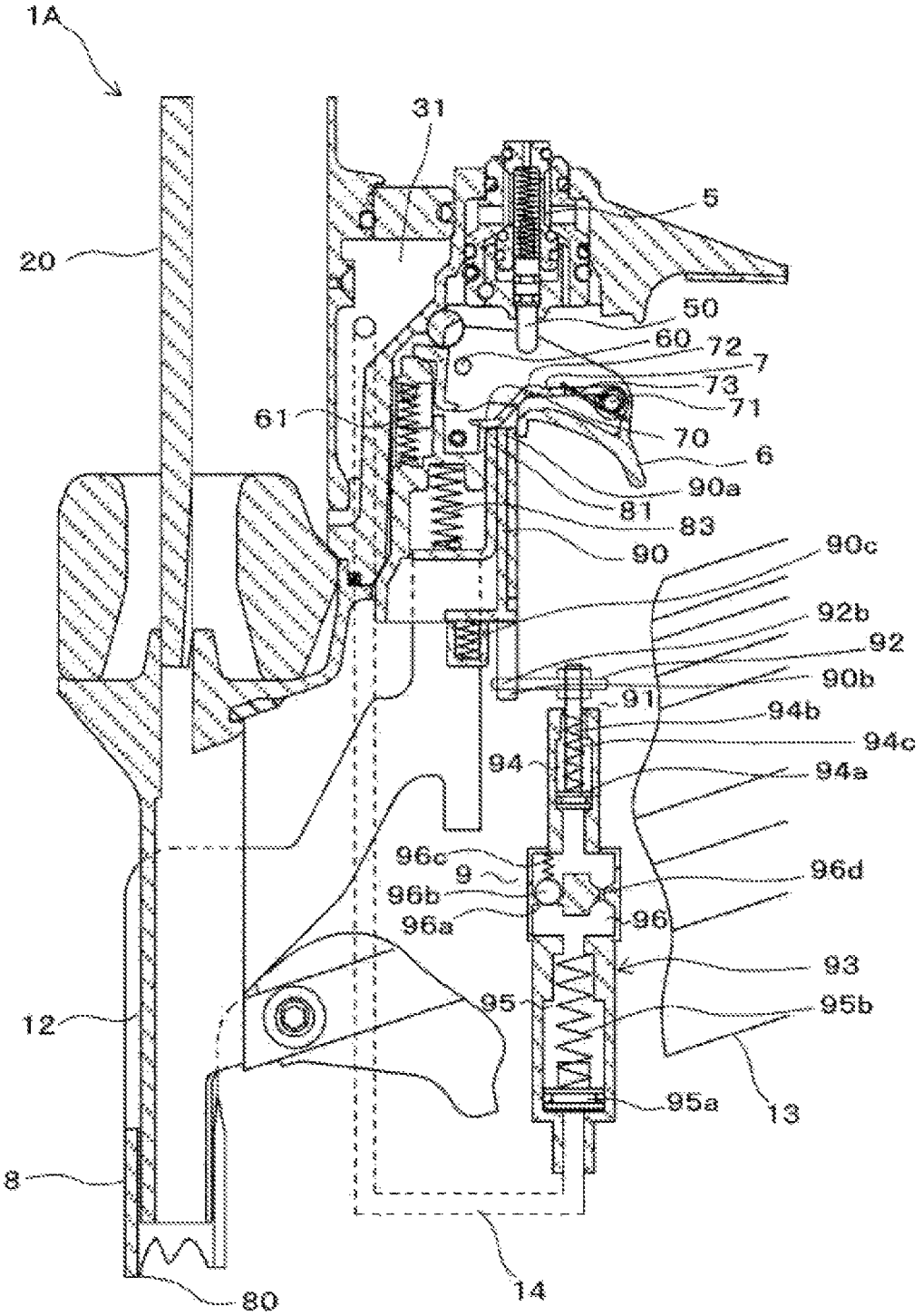
FIG. 1 is a diagram showing a main configuration of a nailing machine according to a first embodiment.
Figure 2:
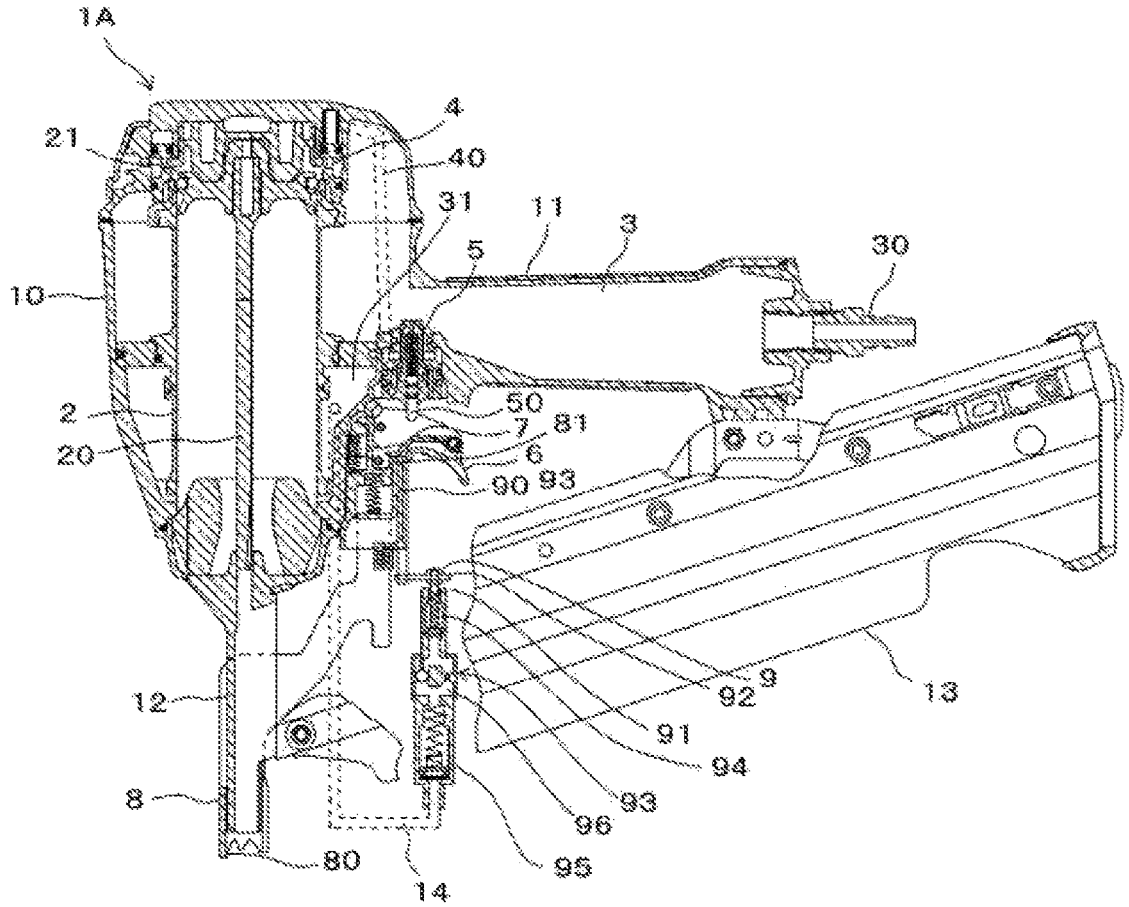
FIG. 2 is a diagram showing whole configuration of a nailing machine according to the first embodiment.

FIG. 1 is a diagram showing a main configuration of a nailing machine according to a first embodiment, and FIG. 2 is a diagram showing whole configuration of the nailing machine according to the first embodiment.

A nailing machine 1A according to the first embodiment includes a striking mechanism 2 including an air cylinder, etc. that operates by using a fluid such as compressed air as a driving source to perform a striking operation, and an air chamber 3 in which the compressed air supplied from an external air compressor (not shown) is stored. In the nailing machine 1A, the striking mechanism 2 is provided in a housing 10 extending in one direction, and the air chamber 3 is provided in a handle 11 extending from the housing 10 in another direction. In the nailing machine 1A, a blowback chamber 31 is provided around a lower portion of the striking mechanism 2 in the housing 10.

The striking mechanism 2 includes a driver 20 that strikes a nail, etc. (not shown), and a piston 21 in which the driver 20 is provided, wherein the piston 21 is provided to slide. In the striking mechanism 2, when the piston 21 is pressed by the compressed air, the piston 21 moves to drive the driver 20.

The compressed air is supplied to the air chamber 3 from a compressed air source, such as an air compressor, via an air plug 30 provided at an end portion of the handle 11. The compressed air for returning the piston 21 after the striking operation to an initial position is supplied to the blowback chamber 31.

The nailing machine 1A includes a nose 12 for accommodating the driver 20 at an end portion of the housing 10, and a magazine 13 for supplying a nail (not shown) to the nose 12. The nose 12 extends along a movement direction of the driver 20. In consideration of an aspect of using the nailing machine 1A, a side including the nose 12 is defined as a downward direction.

The nailing machine 1A includes a main valve 4 that controls inflow/outflow of the compressed air in the air chamber 3 and makes the piston 21 reciprocate, and a starting valve 5 that operates the main valve 4. The main valve 4 reciprocates the piston 21 by switching between inflow of the compressed air into the striking mechanism 2 from the air chamber 3 and discharge of the compressed air from the striking mechanism 2 to the outside. The starting valve 5 includes a valve stem 50 that is provided so as to reciprocate, and the valve stem 50 moves a predetermined distance and opens/closes a flow passage 40 to operate the main valve 4 and reciprocate the piston 21 once.

The nailing machine 1A includes a trigger 6 for receiving a manipulation of operating the starting valve 5, a contact arm 8 that moves by receiving a manipulation of pressing the contact arm 8 against a driven member, in which a nail is driven, and a contact lever 7 that is provided so as to operate according to an operation of the trigger receiving the manipulation and an operation of the contact arm 8 receiving another manipulation and is configured to switch an operating state of the striking mechanism 2 by switching an operating state of the starting valve 5. The nailing machine 1A includes a regulator 9 that regulates a movement, a velocity, or a moving amount of the contact lever 7 according to the reciprocating movement of the contact arm 8 for a predetermined time period, and switches the operating states of the contact arm 8 and the contact lever 7 according to whether the contact lever 7 and the contact arm 8 are locked by each other in the present example.

The trigger 6 is provided on a side of the handle 11, that is, on a side where the nose 12 is provided. An end portion of the trigger 6, that is, a side close to the housing 10, is rotatably supported by an axis 60. A side of the trigger 6, which is opposite to the side supported by the axis 60, that is, another end portion away from the housing 10, is biased by a spring 61 in a direction of moving towards the side on which the nose 12 is provided, by a rotating operation about the axis 60.

A movement range of the trigger 6 according to the rotation about the axis 60 is regulated by a collision of the trigger 6 with an abutting portion provided on the housing 10 and the handle 11. In a state where the manipulation of the trigger 6 is released, the trigger 6 is biased by the spring 61 to move to an initial position by rotating about the axis 60. The trigger 6 is moved from the initial position in the rotation operation about the shaft 60 to an operating position where the contact lever 7 may operate the starting valve 5, according to a pulling manipulation.

The contact lever 7 includes a lock portion 70, by which the contact arm 8 may be locked, at an end portion thereof, and the other end portion of the contact lever 7 is rotatably supported by the trigger 6 due to an axis 71. A pressing portion 72 that is capable of pressing the valve stem 50 of the starting valve 5 is provided between the lock portion 70 and the axis 71. In the contact lever 7, a side opposite to the side supported by the axis 71, that is, an end portion where the lock portion 70 is provided, is biased by a spring 73 such as a twisted coil spring in a direction of moving towards the nose 12 through a rotation about the axis 71.

The contact lever 7 is pressed by the contact arm 8, and is moved through the rotation about the axis 71 from an initial position to a location of operating the striking mechanism 2, that is, a preparation position where the valve stem 50 is pressed to operate the starting valve 5 in the present example, depending on the location of the trigger 6. When the trigger 6 is operated, the contact lever 7 is moved with the trigger 6 when the trigger 6 rotates about the axis 60.

As a result, the initial position and the operable position of the contact lever 7 are relative positions varying depending on a location of the trigger 6, and positions of the lock portion 70 and the pressing portion 72 of the contact lever 7 vary depending on whether the trigger 6 is at the initial position or a manipulation position and whether the contact lever 7 is at the initial position or the operable position.

The contact lever 7 is moved from the initial position to the operable position according to the operation of the contact arm 8, and is moved from the operable position to the initial position according to operations of the contact arm 8 and the regulator 9. The movement of the contact lever 7 between the initial position and the operable position will be described in detail later.

In a state where the trigger 6 and the contact lever 7 are moved to the initial position, the pressing portion 72 of the contact lever 7 is not in contact with the valve stem 50 of the starting valve 5. In a state where the contact lever 7 is moved to the initial position, the pressing portion 72 of the contact lever 7 is not in contact with the valve stem 50 of the starting valve 5 even when the trigger 6 is moved to the operable position. On the other hand, in a state where the contact lever 7 is moved to the operating position, when the trigger 6 is moved to the manipulation position, the pressing portion 72 of the contact lever 7 presses the valve stem 50 of the starting valve 5, and thus, the contact lever 7 may operate the starting valve 5.

The contact arm 8 is provided to be movable along an extending direction of the nose 12, and includes an abutting portion 80 that is brought into contact with a driven member at a proximal end side of the nose 12. The contact arm 8 includes a pressing portion 81 operating the contact lever 7 and a second pressing portion 82 operating the regulator 9. The contact arm 8 is pressed by a spring 83 in a direction of protruding from the proximal end side of the nose 12.

When the abutting portion 80 is pressed in contact with the driven member, the contact arm 8 is moved from the initial position to the operating position where the pressing portion 81 operates the contact lever 7.

When the pressing portion 81 is locked by the lock portion 70 of the contact lever 7 by the operation of the contact arm 8 moving from the initial position to the operating position, the contact lever 7 is operated by the operation of the contact arm 8 and the contact lever 7 is moved from the initial position to the operable position. Whether the lock portion 70 of the contact lever 7 and the pressing portion 81 of the contact arm 8 are locked or unlocked depends upon the position of the contact lever 7.

That is, in a state where the trigger 6 is moved to the initial position, when the contact arm 8 is moved to the operating position, the pressing portion 81 of the contact arm 8 is locked by the lock portion 70 of the contact lever 7 and the contact lever 7 is moved to the operating position. As such, when the trigger 6 is moved to the operating position, the pressing portion 72 of the contact lever 7 presses the valve stem 50 of the starting valve 5 and the contact lever 7 may operate the starting valve 5.

On the contrary, when the trigger 6 is moved to the operating position while the contact arm 8 is moving to the initial position, the pressing portion 81 is not locked by the lock portion 70 of the contact lever 7 even when the contact arm 8 is moved, and the pressing portion 72 of the contact lever 7 may not press the valve stem 50 of the starting valve 5 even when the trigger 6 is moved to the operating position.

As such, even when the trigger 6 is manipulated first and the contact arm 8 is manipulated, the starting valve 5 may not be operated, and when the contact arm 8 is pressed against the driven member, the continuous strike operation may not be performed. In the present embodiment, by providing the regulator 9, when the contact arm 8 is manipulated first and the trigger 6 is manipulated, the continuous strike operation may be enabled according to whether the contact arm 8 is manipulated or not for a predetermined time period.

The regulator 9 includes a regulation member 90 that regulates the movement, the velocity, or the moving amount of the contact lever 7 and regulates the position of the contact lever 7 to an operation standby position where the contact arm 8 may be operated. The operation standby position is a lockable position where the contact lever 7 may be locked by the contact arm 8. Also, the regulator 9 includes a damper 91 that maintains a state in which the contact lever 7 is located at the lockable position for a predetermined time period by controlling movement of the regulation member 90 that regulates the contact lever 7 at the lockable position. The regulator 9 is partially or entirely provided on an outer portion of the housing 10.

The lockable position of the contact lever 7 is a location or a range in which the contact lever 7 and the contact arm 8 may be locked by each other, and while the contact lever 7 stays at the location or the range, the contact arm 8 may operate the contact lever 7.

Therefore, the regulator 9 regulates the movement, the velocity, or the moving amount of the contact lever 7, the movement of the contact lever 7 in the present example, so that the contact lever 7 that has started to move from a preparation position may not pass over the lockable position for a predetermined time period.

The regulation member 90 is provided to be movable along a movement direction of the contact arm 8, and includes a pressing portion 90*a* that presses the contact lever 7 at an end portion thereof along the movement direction. Also, the regulation member 90 includes a locked portion 90*b* that may be locked by the damper 91.

The pressing portion 90*a* of the regulation member 90 is pressed by a spring 90*c* in a direction approaching the contact lever 7. The pressing portion 90*a* of the regulation member 90 presses the lock portion 70 of the contact lever 7, when the pressing portion 90*a* is adjacent to the pressing portion 81 of the contact arm 8 and the regulation member 90 is pressed to move by the spring 90*c*.

In addition, the regulation member 90 moves from the initial position, at which the pressing portion 90*a* is not in contact with the contact lever 7, to a return regulated position where the pressing portion 90*a* presses the contact lever 7 that is pressed by the contact arm 8 to move to the operable position to regulate the position of the contact lever 7 at the lockable position where the contact lever 7 and the contact arm 8 may be locked by each other.

The damper 91 includes a moving member 92 for moving the regulation member 90, and a controller 93 for controlling a velocity of the moving member 92. The regulator 9 is operated by the compressed air supplied from a working fluid passage 14. In the present example, the compressed air is supplied to the regulator 9 from the blowback chamber 31 filled with the air for returning the driver 20 after driving a nail (fastener). Since the compressed air is supplied to the blowback chamber 31 at a timing of returning the driver 20, the regulator 9 is operated by the compressed air only immediately after the nailing operation. The moving member 92 moves from an initial position where the regulation member 90 is moved to an initial position to a time measurement starting position where a measurement of time for regulating a movement, a velocity, or a moving amount of the contact lever 7 that has moved to the lockable position, the moving amount in the present example, is started. The moving member 92 is provided to be movable along a movement direction of the regulation member 90, and includes a lock portion 92*b* locked by the locked portion 90*b* of the regulation member 90.

The regulator 9 is provided with the locked portion 90*b* of the regulation member 90 on a movement path of the second pressing portion 82 of the contact arm 8 that moves from the initial position to the operating position. The damper 91 moves from the initial position where the moving member 92 moves the regulation member 90 to the initial position since the pressed portion 92*a* is pressed by the operation of the contact arm 8, to the operable position by being pressed by the contact arm, and after that, moves to the time measurement starting position where a measurement of a time for regulating the moving amount of the contact lever 7 that has moved to the lockable position when the manipulation of the contact arm 8 is released starts.

The locked portion 90*b* of the regulation member 90 is provided on a movement path of the locked portion 90*b* according to the movement of the moving member 92. The damper 91 may release the locked state between the lock portion 92*b* of the moving member 92 and the locked portion 90*b* of the regulation member 90 by the operation of the moving member 92 moving from the initial position to the time measurement starting position. Therefore, the regulation member 90 is pressed by the spring 90*c* to be moved from the initial position to the return regulated position.

The controller 93 includes an air cylinder 94 for moving the moving member 92, an intermediate cylinder 95 operated when the compressed air is supplied thereto, and a check valve 96 for suppressing backflow of the air from the air cylinder 94 to the intermediate cylinder 95.

The air cylinder 94 is an example of a first cylinder, and includes a piston 94*a*, that is, a first piston, a cylinder shaft 94*b* on which the piston 94*a* is provided, and a spring 94*c* pressing the piston 94*a*. In addition, the moving member 92 is coupled to the cylinder shaft 94*b*.

The intermediate cylinder 95 is an example of a second cylinder, and includes a piston 95*a*, that is, a second piston, and a spring 95*b* pressing the piston 95*a*. In addition, the working fluid passage 14, the check valve 96, and the air cylinder 94 are shielded by the piston 95*a* in order to regulate the compressed air supplied from an air compressor, etc. from entering the air cylinder 94.

The check valve 96 includes a ball 96*b* opening/closing a flow path 96*a*, a spring 96*c* pressing the ball 96*b* to the flow path 96*a*, and a load passage 96*d* for regulating a flow rate of the air per unit time, by passing the air with a predetermined load.

The controller 93 moves the moving member 92 by using the spring 94*c* of the air cylinder 94 from the time measurement starting position to the initial position, and at the same time, controls a velocity of the moving member 92 using a load (flow rate resistance) that is generated when the air pushed by the piston 94*a* of the air cylinder 94 passes through the load passage 96*d*.

Thus, a time taken for the moving member 92 to move from the time measurement starting position to the initial position may be controlled, and a time taken for the regulation member 90 to move from the return regulated position to the initial position may be controlled. Therefore, a time taken for the contact lever 7 that has moved to the lockable position to return to the initial position may be controlled.

An Example of a Nailing Operation According to the First Embodiment

FIGS. 3 to 8 are diagrams for describing an example of driving a nail according to the first embodiment, and operations of the nailing machine 1A according to the first embodiment will be described below with reference to accompanying drawings.

In an initial state, as shown in FIG. 1, the trigger 6 is at the initial position without being pulled, and the contact arm 8 is also at the initial position without being pushed by the driven member. Therefore, the contact lever 7, the regulation member 90, and the moving member 92 are respectively at the initial positions thereof.

In the initial state in which the trigger 6 is at the initial position and the contact lever 7 is at the initial position, the lock portion 70 of the contact lever 7 is located on the movement path of the pressing portion 81 of the contact arm 8.

Figure 3:
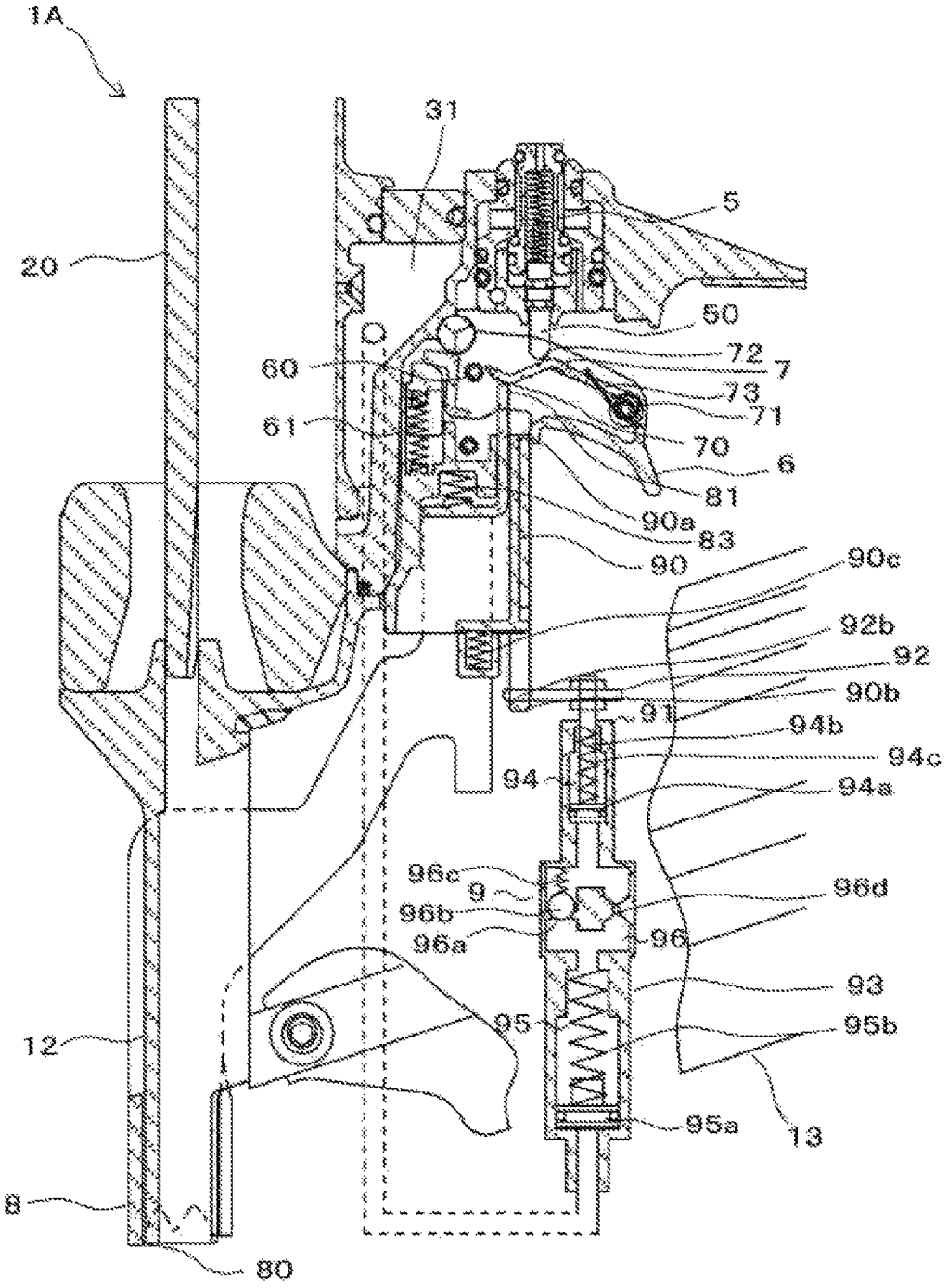
FIG. 3 is a diagram for illustrating an example of a nail driving operation according to the first embodiment.

In the initial state of FIG. 1, when the contact arm 8 is forcedly moved by the driven member from the initial position to the operating position, the pressing portion 81 of the contact arm 8 presses the lock portion 70 of the contact lever 7 as shown in FIG. 3. Then, the contact lever 7 is moved from the initial position to a preparation position where the valve stem 50 of the starting valve 5 may be pressed to operate the starting valve 5, by rotating about the axis 71. Even when the contact lever 7 moves to the operating position, the valve stem 50 is not pressed by the contact lever 7 unless the trigger 6 is moved to the operating position.

Figure 4:
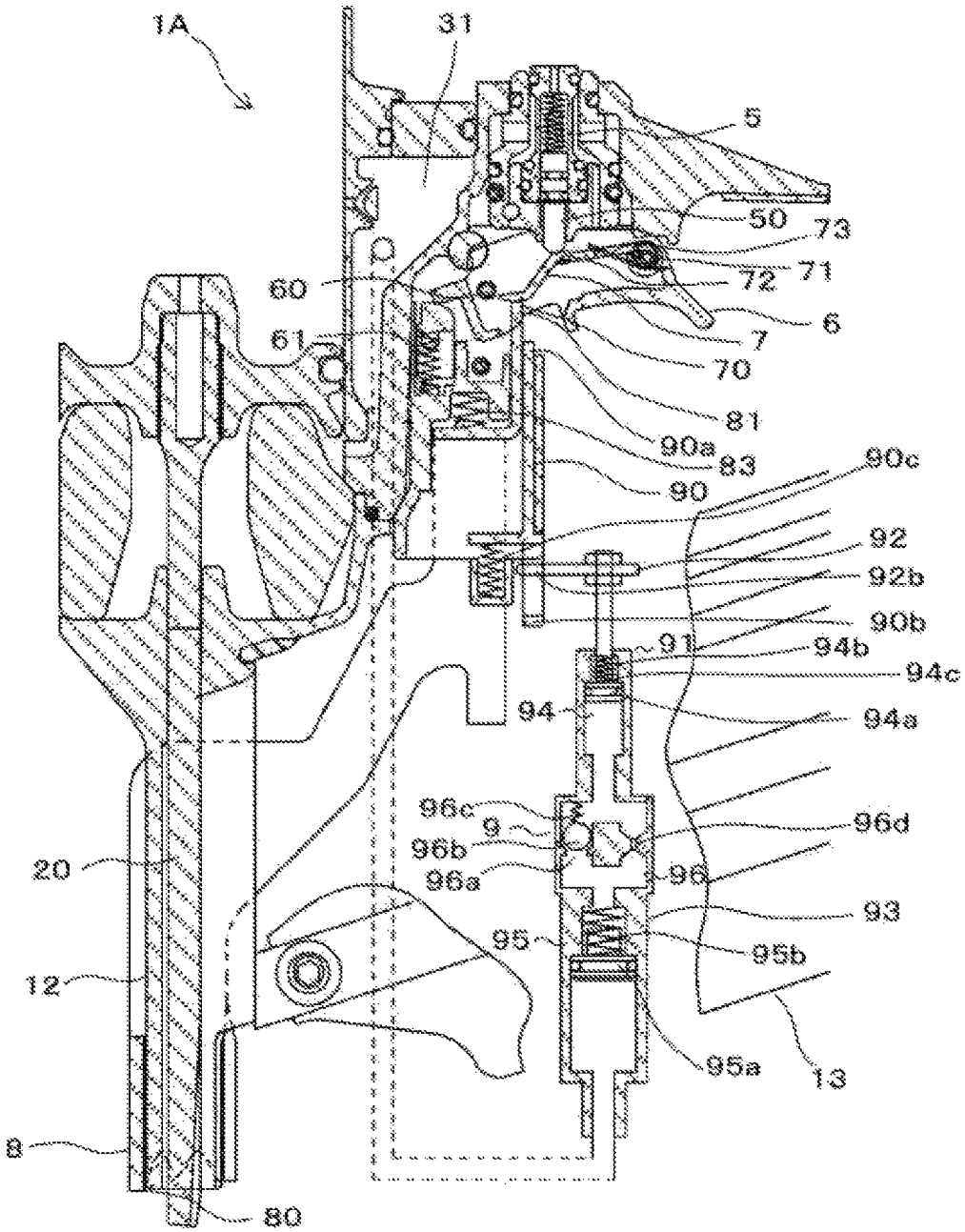
FIG. 4 is a diagram for illustrating an example of a nail driving operation according to the first embodiment.

After the contact arm 8 is moved to the operating position by being forcedly pressed by the driven member in the initial state, when the trigger 6 is pulled to be moved from the initial position to the operating position, the pressing portion 72 of the contact lever 7, which is at the operable position, presses the valve stem 50 of the starting valve 5, as shown in FIG. 4. As a result, the main valve 4 is controlled, the striking mechanism 2 is driven by the compressed air, and the driver 20 is moved in a direction in which a fastener (not shown), that is, a nail in the present example, is driven. Thus, an operation of driving a nail (not shown) may be performed. After the driving operation, the compressed air is supplied from the blowback chamber 31 to the striking mechanism 2, and the driver 20 moves in a returning direction.

In addition, together with the driving operation of a nail, when some of the compressed air is supplied from the blowback chamber 31 to the intermediate cylinder 95 of the damper 91, the piston 95*a* is pressed. When the piston 95*a* is pressed, the air in the damper 91 is compressed, the air is supplied from the intermediate cylinder 95 to the check valve 96, and then, the ball 96*b* of the check valve 96 is pressed.

As a result, the flow path 96*a* of the check valve 96 is open and the compressed air is supplied to the air cylinder 94. The piston 94*a* of the air cylinder 94 is pressed when the air is supplied from the intermediate cylinder 95. Therefore, the moving member 92 provided on the cylinder shaft 94*b* of the air cylinder 94 moves from the initial position to the time measurement starting position.

When the moving member 92 moves to the time measurement starting position, the locked state between the lock portion 92*b* of the moving member 92 and the locked portion 90*b* of the regulation member 90 is released, and the regulation member 90 is pressed by the spring 90*c* to move from the initial position to the return regulated position.

Figure 5:
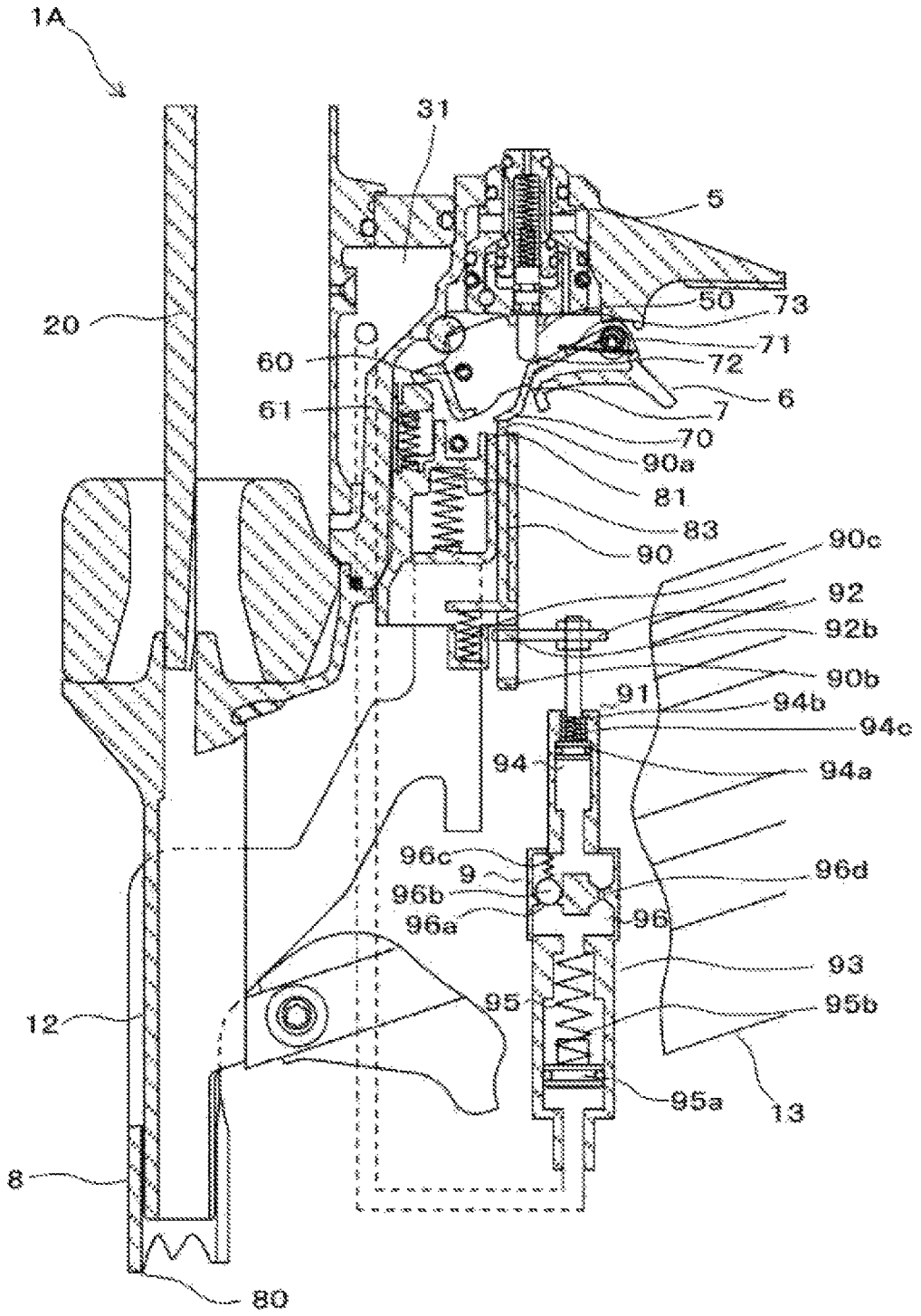
FIG. 5 is a diagram for illustrating an example of a nail driving operation according to the first embodiment.

After the driving operation, while the trigger 6 is maintained at the operating position in a state of being pulled, when the force applied to the contact arm 8 is released, as shown in FIG. 5, the contact arm is moved from the operating position to the initial position by a force of the spring 83.

When the contact arm 8 is moved to the initial position, the pressed state of the contact lever 7 by the pressing portion 81 is released, and the contact lever 7 starts to move in a direction of returning to the initial position from the operable position by rotating about the axis 71 due to the spring 73.

The pressing portion 90*a* of the regulation member 90 moving to the return regulated position is located on the movement path of the contact lever 7, and regulates the movement of the contact lever 7 that moves in a direction of returning from the operable position to the initial position.

As a result, when the contact arm 8 moves to the initial position, the contact lever 7 moves until the contact lever 7 contacts the pressing portion 90*a* of the regulation member 90 and then stops at the lockable position. In addition, the lock portion 70 of the contact lever 7 that moved to the lockable position is located on a movement path of the pressing portion 81 of the contact arm 8.

When supply of the compressed air from the working fluid passage 14 is stopped and the blowback chamber 31 is open to the atmospheric pressure so as to exhaust the air in the working fluid passage 14, the piston 95*a* of the intermediate cylinder 95 is pressed by the compressed air in the intermediate cylinder 94 and the spring 95*b* and starts to move in a direction of returning to the initial position. When the piston 95*a* of the intermediate cylinder 95 moves in the direction of returning to the initial position, the pressure in the intermediate cylinder 95 decreases, and thus, the compressed air pressing the piston 94*a* of the air cylinder 94 is applied to the ball 96*b* of the check valve 96. As a result, the ball 96*b* of the check value 96 is pressed by the spring 96*c* to block the flow path 96*a*, so that the air flows through the flow path 96*a*. In addition, since the pressure in the intermediate cylinder 95 decreases, the air flows from the air cylinder 94 to the intermediate cylinder 95 via the load passage 96*d*, and when the piston 94*a* of the air cylinder 94 is pressed by the spring 94*c*, the moving member 92 starts to move in a direction of returning to the initial position from the time measurement starting position.

Figure 6:
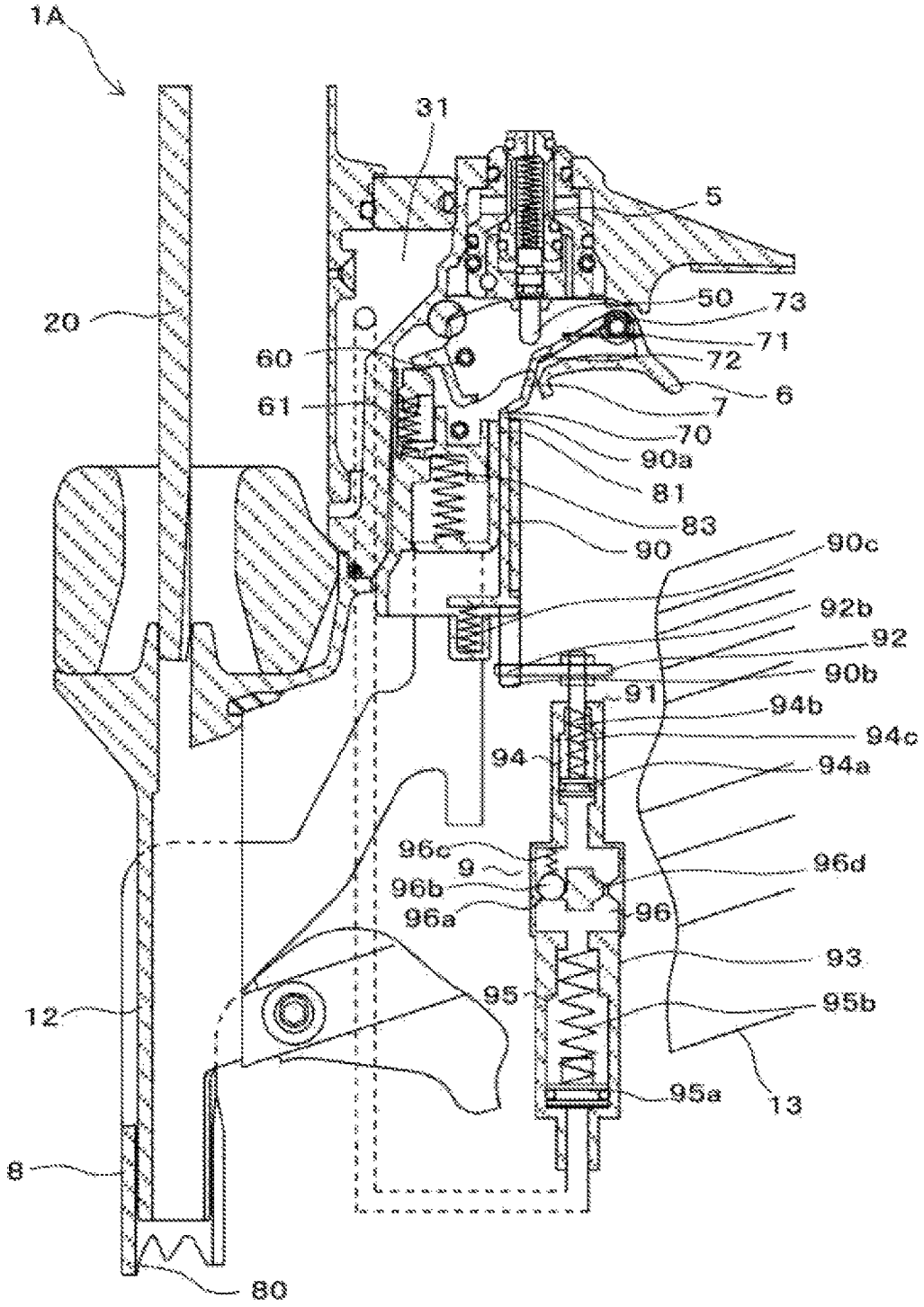
FIG. 6 is a diagram for illustrating an example of a nail driving operation according to the first embodiment.

The velocity of the moving member 92 is determined according to a velocity of the piston 94*a* of the air cylinder 94. The piston 94*a* is moved when pressed by the spring 94*c*, and the movement of the piston 94*a* is controlled when a flow rate of the air discharged from the air cylinder 94 due to the movement of the piston 94*a* is restricted by the resistance of the load passage 96*d*. As a result, as shown in FIG. 6, the lock portion 92*b* of the moving member 92 and the locked portion 90*b* of the regulation member 90 are not in locked state until the moving member 92 moves to the initial position, and the regulation member 90 stops at the return regulated position.

Therefore, while the moving member 92 moves from the time measurement starting position to the initial position, the contact lever 7 is stopped at the lockable position, and the lock portion 70 is located on the movement path of the pressing portion 81 of the contact arm 8.

As a result, while the trigger 6 is maintained at the operating position in a state of being pulled, before a predetermined time period passes after the contact arm 8 moves to the initial position and before the moving member 92 moves from the time measurement starting position to the initial position, when the contact arm 8 is moves from the initial position to the operating position by being pressed by the driven member again, the pressing portion 81 of the contact arm 8 may press the lock portion 70 of the contact lever 7.

Therefore, after the contact arm 8 is moved to the initial position while maintaining the trigger 6 at the operating position in a state of being pulled, when the contact arm 8 is moved again to the operating position, as shown in FIG. 4, the lock portion 70 of the contact lever 7 is pressed by the pressing portion 81 of the contact arm 8, the contact lever 7 is moved to the operating position, and then, the pressing portion 72 presses the valve stem 50 of the starting valve 5.

Therefore, while the trigger 6 is maintained at the operating position in a state of being pulled, continuous striking operations may be performed for a predetermined time period by pressing the contact arm 8 against the driven member.

On the other hand, while the trigger 6 is at the operating position in a state of being pulled, when a predetermined time passes after the contact arm 8 moves to the initial position, the moving member 92 is moved to the initial position by the air cylinder 94.

Figure 7:
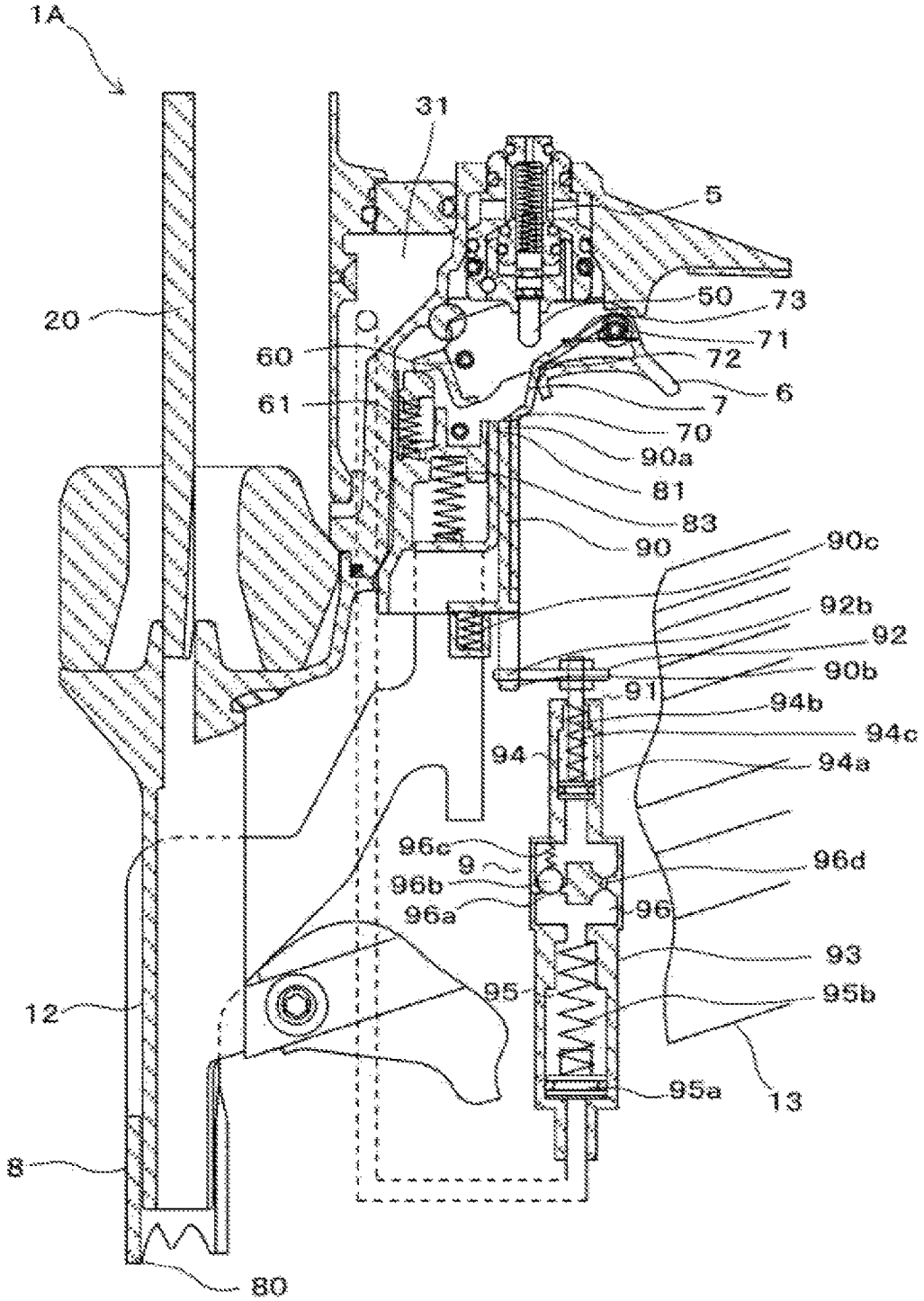
FIG. 7 is a diagram for illustrating an example of a nail driving operation according to the first embodiment.

When the moving member 92 is moved to the initial position, as shown in FIG. 7, the lock portion 92*b* of the moving member 92 and the locked portion 90*b* of the regulation member 90 are locked by each other. Then, the regulation member 90 pressed by the moving member 92 that is moved by air cylinder 94 is moved from the return regulated position to the initial position.

When the regulation member 90 is moved to the initial position, the contact lever 7 is moved from the lockable position to the initial location by rotating about the axis 71 due to the spring 73, in a case where the trigger 6 is at the operating position. When the contact lever 7 is moved to the initial position in a state where the trigger 6 is maintained at the operating position, the lock portion 70 of the contact lever 7 is evacuated from the movement path of the pressing portion 81 of the contact arm 8.

Figure 8:
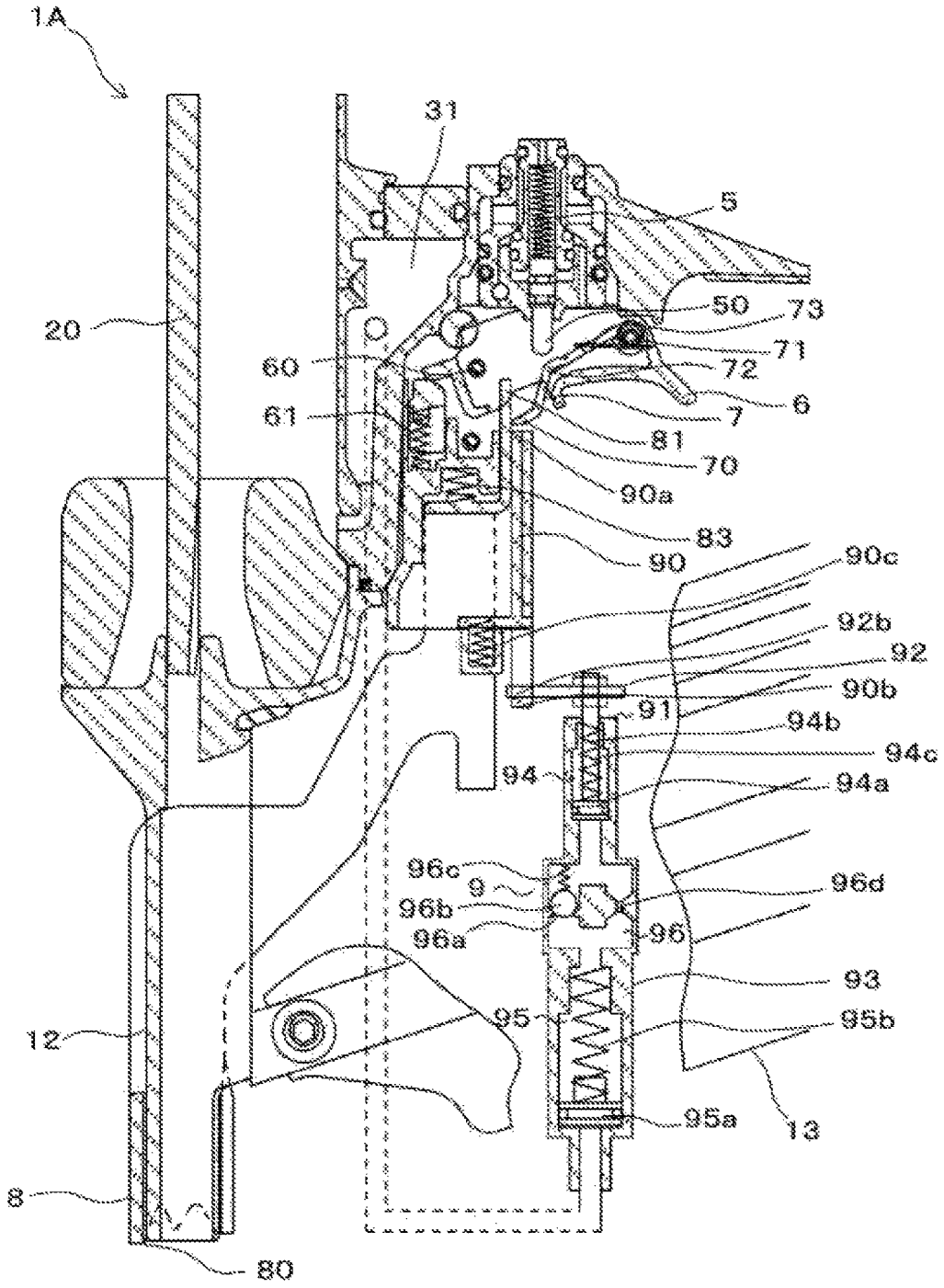
FIG. 8 is a diagram for illustrating an example of a nail driving operation according to the first embodiment.

As a result, after the contact arm 8 is moved to the initial position, when a predetermined time passes while the trigger 6 is maintained at the operating position in a state of being pulled, as shown in FIG. 8, the pressing portion 81 of the contact arm 8 does not contact the lock portion 70 of the contact lever 7 and the contact lever 7 is not pressed even when the contact arm 8 is moved to the operating position by the operation of pressing the contact arm 8 against the driven member.

Therefore, the starting valve 5 is not pressed by the contact lever 7, and the striking operation is not performed. Therefore, while the trigger 6 is maintained at the operating position in a state of being pulled, the contact arm 8 is pressed against the driven member, and thus, the continuous nailing operations may be controlled according to lapse of time using a mechanical configuration operated by the compressed air.

Since the intermediate cylinder 95 is operated by the compressed air supplied from the blowback chamber 31, the air cylinder 94 is operated by the compressed air generated by the operation of the intermediate cylinder 95, the moving member 92 and the regulation member 90 are operated by the air cylinder 94, and measurement of a time for maintaining the contact lever 7 at the lockable position (operation standby position) where the contact lever 7 is enabled to operate by the contact arm 8, the time measurement may start after driving a nail (fastener), and the contact lever 7 may be restricted from being inactivated because the time measurement is finished before driving the nail.

A configuration of maintaining the locked state between the contact lever and the contact arm for a predetermined time period by decreasing the velocity of the contact lever to increase a time taken for the contact lever to move to the initial position may be suggested.

However, it is difficult to stably decrease the velocity of the contact lever, and it is also difficult to stably switch the locked state between the contact lever and the contact arm at a predetermined timing. On the other hand, by providing the regulation member 90 for regulating the movement of the contact lever 7 and controlling the movement of the regulation member 90 by using the damper 91, the locked state between the contact lever 7 and the contact arm 8 may be stably switched at a predetermined timing by using a mechanical configuration.

Alternatively, a configuration of combining the damper with the trigger may be suggested in order to decrease the velocity of the contact lever. However, since there is a need to combine the mechanical time measurement mechanism in a restricted area, for example, it is difficult to stably decrease the velocity of the contact lever in order to measure the time. On the other hand, by providing the regulator 9 on an outer portion of the trigger 6, a limitation in a space for combining the time measurement mechanism may be eliminated, for example, a mechanical time measurement mechanism that operates by the compressed air as a driving source may be provided. A configuration for stably performing a measurement operation, for example, increasing of a moving amount of the air cylinder 94 by providing the regulator 9 on an outer portion of the housing 10, may be easily implemented.

In the configuration of directly operating the air cylinder 94 by using the compressed air through the air chamber 3, dust or oil in the air may enter the air cylinder 94. When foreign substance such as dust or oil enters the air cylinder 94, the reciprocating movement of the piston 94*a* may be hindered. In addition, the air cylinder 94 may not normally operate due to a variation in the pressure of the compressed air supplied to the nailing machine 1A.

On the other hand, by providing the intermediate cylinder 95, the working fluid passage 14, the check valve 96, and the air cylinder 94, through which the compressed air passes, may be shielded by the piston 95*a* so as to prevent the compressed air supplied from the air compressor, etc. from entering the air cylinder 94. Therefore, the foreign substance may be prevented from entering the air cylinder 94, and thus, the air cylinder 94 may be normally operated.

In the nailing machine 1A using the compressed air supplied from the outside, e.g., the air compressor, etc. as a driving source, the pressure of the air supplied from the air compressor to the nailing machine 1A may be adjusted, and the pressure of the compressed air supplied from the outside may vary. Further, an amount of the air consumed in the nailing machine 1A increases and the air supplied from the air compressor is insufficient, and thus, the pressure of the compressed air supplied from the outside varies.

On the other hand, the intermediate cylinder 95 is operated by using the compressed air supplied from the outside and the air cylinder 94 is operated by using the compressed air generated by the operation of the intermediate cylinder 95, and thus, the air cylinder 94 may be hardly influenced by a variation, etc. in the pressure of the compressed air supplied from the outside.

In the present example, the intermediate cylinder 95 and the air cylinder 94 are described to operate with the compressed air that is the driving source of the nailing machine 1A, but a cylinder using other gases such as $CO_2$ than the air, a hydraulic cylinder using an oil, etc. may be used. Since the air cylinder 94 is shielded from the outside by the piston 95*a* of the intermediate cylinder 95, the intermediate cylinder 95 may be operated by the compressed air and the air cylinder 95 may be operated by other fluids than the compressed air.

When a predetermined time passes after finishing the nailing operation as described above, the contact lever 7 is moved to the initial position. After the contact lever 7 is moved to the initial position, the contact arm 8 is moved to the initial position by releasing the force applied to the contact arm 8. Also, the trigger 6 is moved to the initial position when the force of pulling the trigger 6 is released. As a result, the initial state as shown in FIG. 1 may be obtained. In the initial state, the lock portion 70 of the contact lever 7 is moved to the movement path of the pressing portion 81 of the contact arm 8.

As shown in FIG. 3, after the contact arm 8 is moved to the operating position by pressing the contact arm 8 against the driven member, as shown in FIG. 4, when the trigger 6 is pulled to move to the manipulation position, the valve stem 50 of the starting valve 5 is pressed by the contact lever 7 moving to the operable position and the nailing operation may be performed.

In the initial state shown in FIG. 1, when the trigger 6 is pulled and moved to the operating position before pressing the contact arm 8 against the driven member, the lock portion 70 of the contact lever 7 is evacuated from the movement path of the pressing portion 81 of the contact arm 8.

As a result, after setting the trigger 6 at the operating position in a state of pulling the trigger 6, even when the contact arm 8 is moved to the operating position by pressing the contact arm 8 against the driven member, the pressing portion 81 of the contact arm 8 does not contact the lock portion 70 of the contact lever 7 and thus the contact lever 7 is not pressed.

Therefore, the valve stem 50 of the starting valve 5 is not pressed by the contact lever 7, and the striking operation is not performed. Therefore, before the trigger 6 is pulled, a nailing operation caused by other operations than a regular procedure of pressing the contact arm 8 against the driven member may be restricted.

In the above-described embodiment, the regulator 9 is configured to operate with the compressed air supplied from the blowback chamber 31 that is filled with the air for returning the driver 20 after driving the nail (fastener). On the other hand, the regulator 9 may be supplied with the compressed air from the striking mechanism 2, or from the starting valve 5. Alternatively, the compressed air operating a feed member of a nail (not shown) may be supplied.

What is claimed is:

1. A driving tool which is configured to drive a fastener supplied to a nose by using a striking mechanism which is operated by a fluid to be supplied, the driving tool comprising:

a trigger that is configured to receive a manipulation which operates the striking mechanism;

a contact arm that is configured to receive another manipulation which operates the striking mechanism;

a contact lever that is configured to operate according to operations of the trigger and the contact arm and that is configured to switch operating states of the striking mechanism; and a regulator that is configured to switch operating states of the contact lever according to the contact arm, wherein the regulator includes:

a regulation member that is configured to regulate a position of the contact lever at an operation standby position where the contact lever is operated by the contact arm; and a controller that is configured to operate the regulation member, and the controller includes:

a first cylinder that is configured to operate the regulation member; and a second cylinder to which the fluid operating the striking mechanism is partially supplied and that is configured to generate a driving force for driving the first cylinder;

wherein the regulator includes a moving member that is configured to operate the regulation member, and the controller is configured to control moving time of the moving member by controlling moving time of a piston of the first cylinder to regulate the position of the contact lever at the operation standby position by using the regulation member for a predetermined time period.

2. The driving tool according to claim 1, wherein the controller is configured to control a velocity of the moving member by controlling a velocity of a piston of the first cylinder to regulate the position of the contact lever at the operation standby position by using the regulation member for a predetermined time period.

3. The driving tool according to claim 2, wherein the controller includes a load passage that is configured to control the velocity of the moving member by interfering with a flow of the fluid discharged from the first cylinder.

4. A driving tool which is configured to drive a fastener supplied to a nose by using a striking mechanism which is operated by a fluid to supplied the driving tool comprising:

a trigger that is configured to receive a manipulation which operates the striking mechanism;

a contact arm that is configured to receive another manipulation which operates the striking mechanism;

a contact lever that is configured to operate according to operations of the trigger and the contact arm and that is configured to switch operating states of the striking mechanism; and a regulator that is configured to switch operating states of the contact lever according to the contact arm, wherein the regulator includes:

a regulation member that is configured to regulate a position of the contact lever at an operation standby position where the contact lever is operated by the contact arm; and a controller that is configured to operate the regulation member, and the controller includes:

a first cylinder that is configured to operate, the regulation member; and a second cylinder to which the fluid operating the mechanism is partially supplied and that is configured to generate a driving force for driving the first cylinder, wherein the regulator moves the regulation member to a position where the second cylinder is operated with an operation of driving a fastener to regulate the position of the contact lever to the operation standby position.

5. The driving tool according to claim 4, wherein when the regulator is supplied with a part of the fluid which returns a driver of the striking mechanism after the driver strikes the fastener, the second cylinder is operated.

6. The driving tool according to claim 3, wherein the second cylinder is configured to shield the first cylinder and the load passage to regulate the fluid from entering the first cylinder, and the load passage regulates the flow of the fluid between the first cylinder and the second cylinder to control the velocity of the moving member.

7. The driving tool according to claim 6, wherein the controller is configured to control the velocity of the moving member by regulating a flow rate resistance which is generated when the fluid passes through the load passage.

* * * * *